United States Patent [19]

Best et al.

[11] 4,195,502

[45] Apr. 1, 1980

[54] BREAK-AWAY DOOR KNOB

[75] Inventors: Walter E. Best; R. Gene McCullum, both of Indianapolis, Ind.

[73] Assignee: Best Lock Corporation, Indianapolis, Ind.

[21] Appl. No.: 911,962

[22] Filed: Jun. 2, 1978

[51] Int. Cl.[2] ..... E05B 63/00

[52] U.S. Cl. ..... 70/224; 70/422

[58] Field of Search ..... 70/224, 422; 292/347, 292/356; 64/28 R

[56] References Cited

U.S. PATENT DOCUMENTS

| | | | |
|---|---|---|---|
| 2,138,856 | 12/1938 | Harp | 70/422 |
| 3,621,685 | 11/1971 | Sargent | 70/107 |

*Primary Examiner*—Robert L. Wolfe

*Attorney, Agent, or Firm*—Jenkins, Coffey, Hyland, Badger & Conard

[57] ABSTRACT

A door knob on a knob sleeve or spindle which is adapted to be blocked from rotation is connected to such spindle by a break-away ring and is otherwise rotatable on the spindle. The break-away ring is mounted about the spindle between the end of the fixed hub of the lock chassis and an internal flange on the knob, and has a pair of radial lugs extending inward to key it to the spindle and a pair of axial lugs extending into the knob flange to key it to the knob. One pair, preferably the axial pair of lugs, is adapted to break away under excessive knob turning force to disconnect the rotative connection of the knob to the spindle.

10 Claims, 7 Drawing Figures

BREAK-AWAY DOOR KNOB

This invention relates to a cylindrical lock set, such as that shown in our U.S. Pat. No. 3,955,387 of May 11, 1976, and particularly to the provision of a torque-limited knob to defeat one form of forced entry attack on such a lock set.

In such a lock set, the outside knob is mounted on a knob sleeve or spindle which is adapted to be blocked from rotation by manipulation of a turn button or the like in the inside knob, and the outside knob carries a key-actuated lock core or the like for actuating the bolt of the lock when the outside knob is blocked from rotation. One method of forced entry attack on such a lock set is to apply a high turning force on the outside knob, as with a pipe wrench or other tool, sufficient to break or overpower the mechanism which blocks the knob spindle from rotation. The present invention provides a torque-limiting connection between the knob sleeve and the knob. The knob is otherwise rotatable on the knob sleeve, and is connected for rotation therewith by a frangible connection which will break away under excessive knob turning force so as to prevent such excessive turning force from breaking or overriding the mechanism which blocks rotation of the knob sleeve when the lock set is set for key operation. Desirably, the frangible connection is a readily replaceable element housed within the knob, and the knob is removable by a standard or conventional procedure to expose the frangible connecting element for removal and replacement.

In a lock set of the type to which the invention is especially applicable, the lock set includes a chassis having an outer cylindrical hub within which the knob sleeve is rotatably mounted, and the knob is mounted on the knob sleeve and has a neck portion telescopically received over the cylindrical hub. Inward thrust on the knob is transmitted directly to the end of the chassis hub by an inner flange on the neck of the knob. In accordance with the present invention, the frangible element is preferably a split ring or the like mounted between the end of the chassis hub and such inner flange, the hub being shortened sufficiently to permit such mounting. The frangible element is keyed to the knob sleeve, as by a set of one or more internal lugs which take into a corresponding set of openings in the cylindrical wall of the sleeve, and is keyed to the knob, as by a set of one or more lugs extending radially forward into a corresponding set of notches in the inner flange of the knob. The frangible element is preferably formed of a synthetic plastics material, and may also form a thust bearing between the knob and the end of the chassis hub. Either or both sets of lugs keying the frangible element to the knob sleeve and the knob may be designed to break away under excessive torque between the knob and the sleeve, but the break away lugs are preferably the lugs which engage in the inner flange of the knob.

The accompanying drawings illustrate the invention, and show a presently preferred embodiment thereof. In such drawings:

FIG. 1 is a horizontal axial section of the outside knob mechanism of a cylindrical lock set of the type shown in U.S. Pat. No. 3,955,387, as modified in accordance with the present invention;

Figure 1:
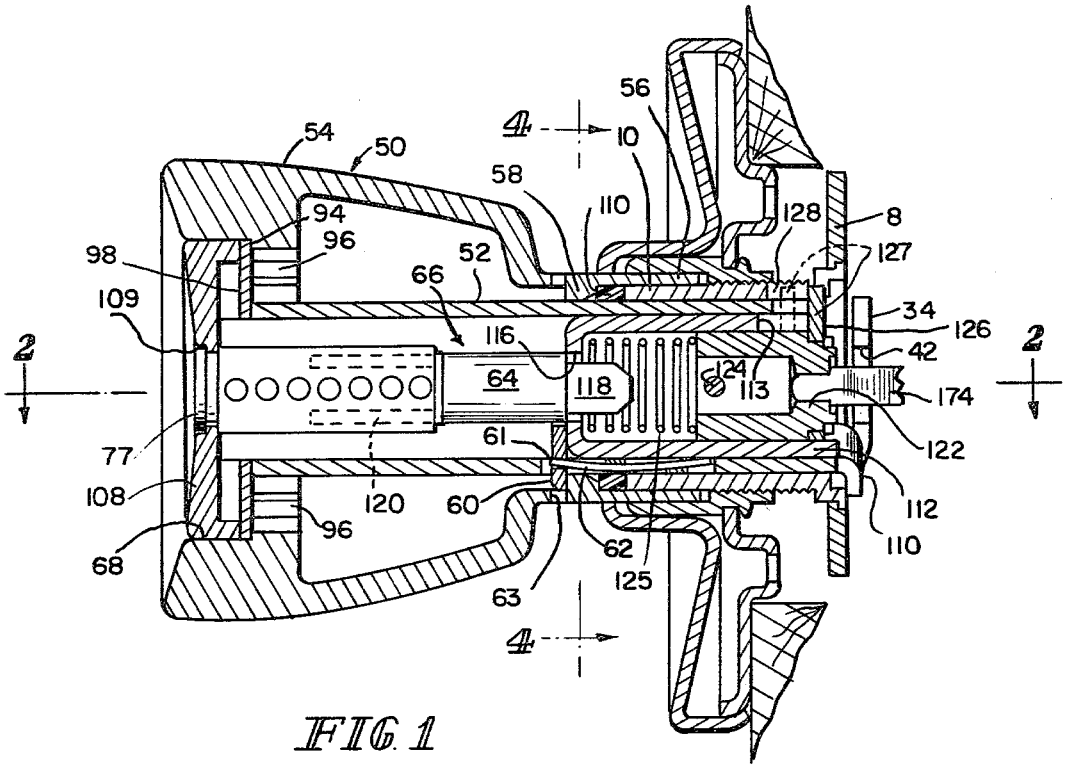

The cylindrical lock set shown in FIG. 1 is in general substantially the same as that of U.S. Pat. No. 3,955,387 and reference is made thereto for further details. The lock set is adapted to provide the so-called "A" function for use in an entrance or office door lock, and is provided with a key lock in the outside knob and a manual locking device in the inside knob. Such lock set comprises a chassis 8 which includes a hub 10 having a wide flange at its inner end which forms a side plate of a retractor frame. The forward end of such frame is connected to a latch bolt housing, such as that of our U.S. Pat. No. 3,798,935 of Mar. 26, 1974, and contains a retractor 34 connected to operate a latch bolt in such housing. Such retractor 34 is spring pressed forward and carries a roll back cam face 42 adapted to be engaged by roll back cams described below.

An outside knob 50 is carried by a knob sleeve 52 rotatably mounted in the outside hub 10. The knob 50 has a hand-hold portion 54 at its outer end and a neck 56 at its inner end, telescopically received over the hub 10 and rotatable thereon. Near the outer end of the neck 56, the knob has an inner flange 58 having a front beveled face. The knob is held against retraction from the hub 10 by a keeper 60 projecting through an opening 61 in the side wall of the knob sleeve 52 and engaged against the outer face of the flange 58. The outer face of the keeper is beveled to ride over the beveled face of the flange 58 as the knob is assembled on the sleeve 52, and the knob has an access opening 63 opposite the end of the keeper to permit insertion of a release tool. The keeper 60 is normally spring-pressed outward by a leaf-spring 62, and is normally blocked from retraction by the cylindrical shank 64 of a throw member 66 which is removable only after first removing the key-controlled lock core as described below. The knob 50 is desirably machined from solid stock, and has a large bore 68 in its outer end.

Figure 5:
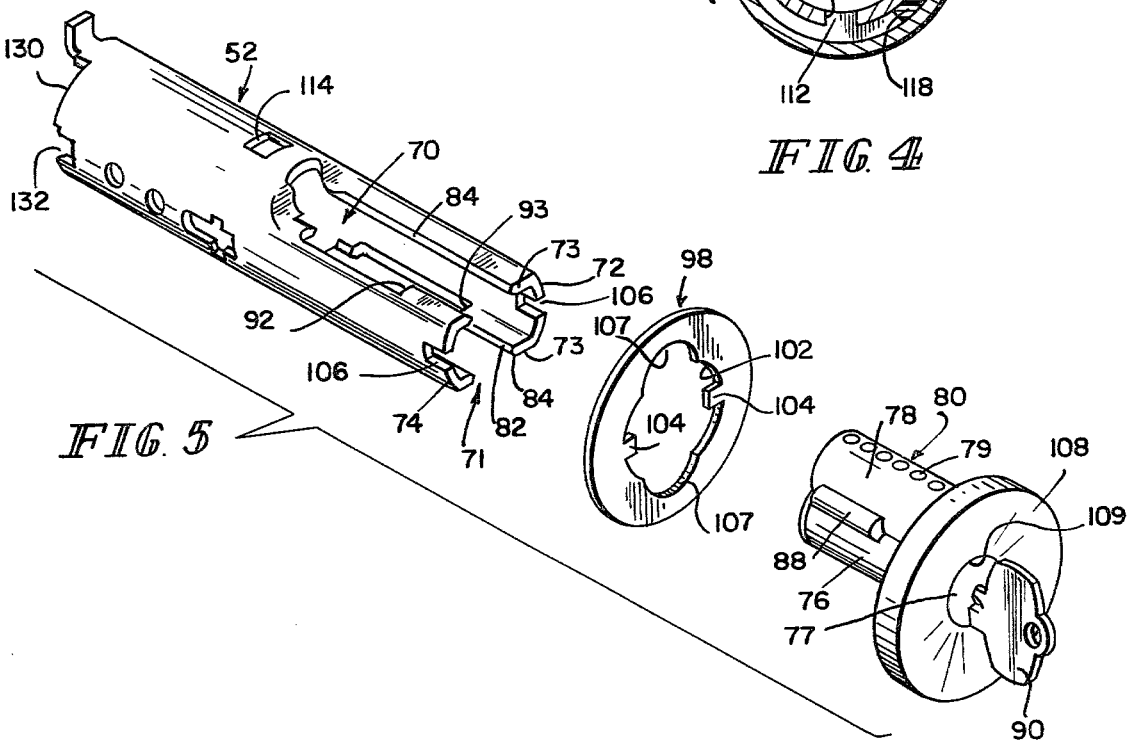
FIG. 5 is an exploded perspective view showing the knob sleeve of FIG. 1 and its relationship with a knob-locating ring and lock core.

As best shown in FIG. 5, the knob sleeve 52 is a generally cylindrical tube which may be formed from flat stock stamped and rolled to shape. Its outer end is formed with two diametrically opposite slots 70 and 71, and the remaining wall portions are shaped to form two diametrically-opposed channel sections 72 and 74. The side legs 73 of the two channel sections extend inward in two chordal planes, and their inner edges are dressed to fit and embrace the lower lobe 76 of a key-removable core 80. Such core may be of figure-8 cross section having a lower lobe 76 containing a key plug 77 and having an upper lobe 78 containing a row of pin tumblers mounted in bores 79.

The core 80 is retained in position by a lug 88 which normally projects through the side of the core and is retractable by use of a special control key 90. To provide for engagement of the lug 88 in the knob sleeve 52, the upper left and lower right beveled edges of the pair of channel sections 72 and 74 are notched to form shoulders 92 and 93 behind which the lug 88 of the core 80 can be engaged to prevent retraction of the core 80 from the knob sleeve.

The two channel sections 72 and 74 are symmetrical about the central axis of the knob sleeve so that they are adapted to receive the core 80 in either of two orientations. As shown in FIG. 5, the sleeve is oriented with the slot 70 at the top, and the tumbler pin lobe 78 of the core is upward and is receivable through that slot 70 at the top of the knob sleeve, so that the core-retaining lug 88 will engage the shoulder 92 on the channel 74. Alternatively, for a door of opposite hand, the chassis and the sleeve 52 can be inverted so that the slot 71 of the sleeve is at the top. In this inverted orientation of the sleeve, the core 80 can again be mounted in upright position, with the key-plug lobe 76 engaged between the channel sections 72 and 74 but with the tumbler lobe 78 in the slot 71 which is now at the top. The knob sleeve 52 is of substantially larger diameter than the lobe 76 of the core 80, and the two channel sections 72 and 74 form structural members of high strength and rigidity so as to withstand forceful tampering with the lock set and knob.

The outer end of the knob 50 is supported from the outer end of the knob sleeve 52, in an arrangement which permits the two alternative orientations of the core 80 in the knob 50. As previously mentioned, the outer end of the knob 50 contains a large bore 68, of a radius substantially larger than the distance from the center of the key plug 77 to the top of the pin tumbler lobe 78. The bore 68 is formed with an outward-facing shoulder 94 intermediate its length, and the bore is of smaller diameter inward of such shoulder. The smaller diameter portion may be broached with four axial slots 96 for use in accordance with U.S. Pat. No. 3,955,387, but are not used here. A locating or guide ring 98 is positioned in the bore 68 against the shoulder 94 and is rotatable in the knob. The center of the guide ring 98 contains a circular opening 102 adapted to fit over the outer cylindrical surfaces of the webs of the two channels 72 and 74, and two tongues 104 extend inward from the periphery of such opening to engage in notches 106 formed in the channels 72 and 74, to fix the guide ring 98 against rotation and axially on the knob sleeve 52. The central opening 102 of the guide ring 98 may have upper and lower extensions 107 to provide clearance for the pin tumbler lobe 78 of the core 80 in either of two orientations.

The outer end of the bore 68 of the knob 50 is closed by a face plate 108 which in this case forms part of the core assembly, but is rotatable with respect to at least one and preferably both of the knob 50 and the core 80. Such plate is provided with a counterbored central opening 109 which receives the key plug 77 of the core. Such key plug has a front flange which engages in the counterbore of the central opening 109, so as to secure the face plate 108 against the front face of the core, while allowing the face plate to rotate with respect to the body of the core.

The lock set is adapted to be mounted in orientations for either a right-hand or left-hand door without modification except only the removal and reinsertion of the face plate and core. When the lock set is to be modified for a door of opposite hand, the control key 90 is operated to retract the retaining lug 88 from behind the shoulder 92 or 93, and the core 80 and the face plate 108 are then free and can be retracted from the knob and knob sleeve. The core and face plate are then inverted, and reinserted in the knob and locked in place by manipulating the control key 90 to advance the retaining lug 88 into engagement behind the appropriate shoulder 92 or 93.

The inner end of the outside knob sleeve 52 is formed with a roll back cam 110, shown in FIG. 1, one end of which is offset axially to lie in the plane of the retractor cam face 42 of the retractor 34.

A key actuated roll back sleeve 112 is rotatably mounted within the inner end of the knob sleeve 52, and carries a roll back cam (not shown) similar to the cam 110 but extending in the opposite direction. The adjacent edges of the knob roll back cam 110 and the key-actuated roll back cam lie in abutting relation, so that rotation of the knob sleeve 52 either way will act through one or the other of the roll back cams to roll back the retractor.

The key-actuated roll back cam sleeve 112 has an end wall at its outer end (FIG. 1) which is provided with a transverse slot 116 which receives the flat end 118 of the throw member 66. The opposite end of the throw member 66 carries a pair of legs 120 which are received in spaced bores in the rear end of the key plug 77 of the core 80. The cylindrical shank 64 of the throw member 66 is held between the rear end of the core 80 and the front end of the key-actuated roll back sleeve 112. As previously mentioned, such shank lies in the path of retraction of the knob keeper 60 to prevent retraction of that keeper when the throw member 66 is in place.

For purposes of locking the knob sleeve 52 and the outside knob 50 against rotation, and thus to limit lock actuation to that provided by the key-actuated core 80, a locking lug bushing 122 is slidably mounted within the key-release roll back sleeve 112. This is held against rotation in the sleeve 112 by a cross-pin 124, but is free to slide axially against a biasing spring 125. The end of the bushing 122 carries a locking lug member 126 having an annular inner portion rotatably fixed on the end of the bushing 122, and having a radial lug portion 127. This radial lug portion, in its release position shown in full lines in FIG. 1, extends across a cut back end face 113 of the cam sleeve 112, across an inward offset end face 130 at the end of the knob sleeve 52 and into a slot 128 at the inner end of the hub 10 of the lock chassis. The locking lug 126 is thereby locked to the hub 10 and against rotation therein, but leaves the sleeves 112 and 52 and the knob 50 free to rotate to retract the lock bolt.

When the locking lug 126 is moved axially from the full line position shown in FIG. 1 leftward to the dotted line position shown in FIG. 1, the lug portion 127 moves into a notch 132 in the end of the knob sleeve (shown in FIG. 5) and thereby locks the knob sleeve 52 to the hub 10 and prevents rotation of the knob sleeve 52. Movement of the locking lug 126 to such locking position is effected by thrusting the bushing 122 outward, to the left in FIG. 1. In an "A" function lock, here shown, thrust for this purpose is exerted through a locking bar 174 from a button in the inside knob.

Figure 2:
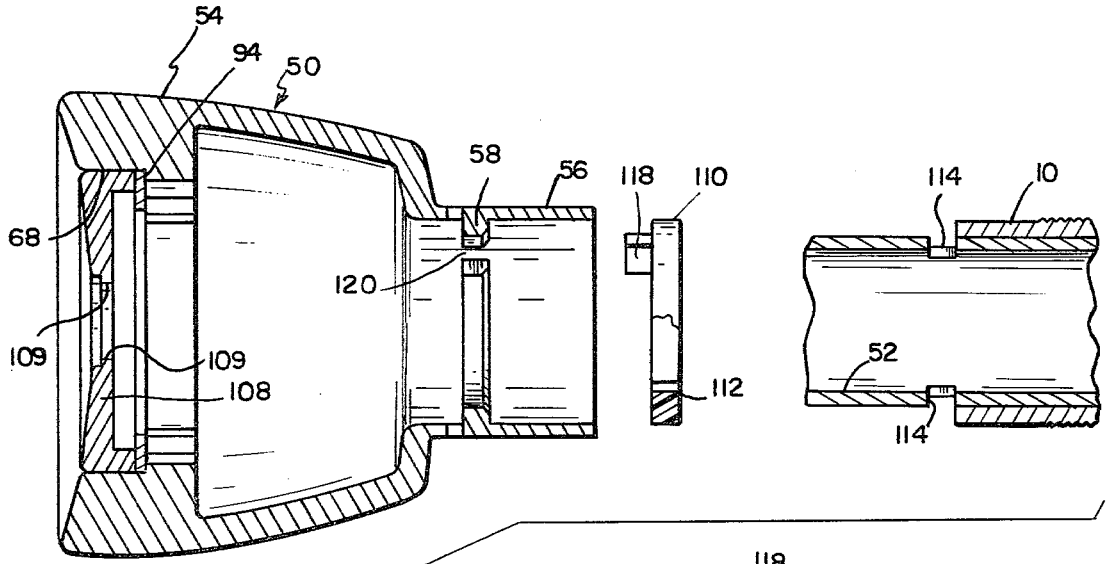
FIG. 2 is an exploded view showing lock mechanism in accordance with the present invention.
Figure 3:
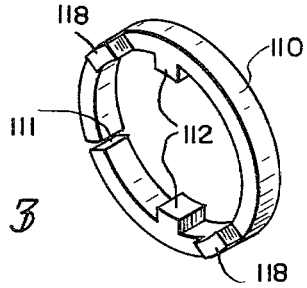
FIG. 3 is a perspective view of the frangible connector ring used in the embodiment of FIGS. 1 and 2.
Figure 4:
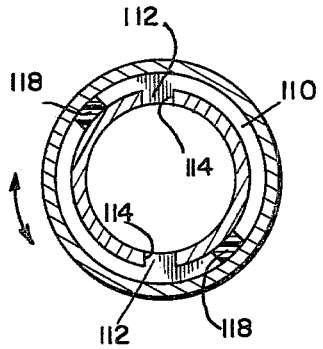
FIG. 4 is a sectional view taken on line 4—4 of FIG. 1.
Figure 7:
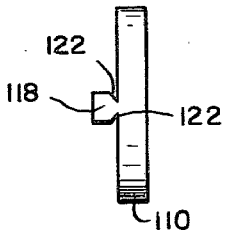
FIG. 7 is a side elevation of a frangible connector ring, showing a modified form of frangible lug for keying such ring to the knob.

In accordance with the present invention, the knob 50 is mounted for rotation on the sleeve 52, and is connected for rotation therewith by a torque-limiting break-away ring 110. As shown in FIG. 1, this is mounted radially between the knob sleeve 52 and the neck 56 of the knob, and axially between the outer end of the fixed chassis hub 10 and the inward beveled face of the inner flange 58 in the neck 56 of the knob 50. It is thus trapped between those parts. As shown in FIGS. 2 and 3, such ring 110 has a pair of sleeve-engaging lugs 112 projecting radially inward at diametrically opposite points. These are desirably located in a vertical plane, 90° from the plane of FIG. 1, and are received in key openings 114 formed in the knob sleeve 52, as shown in FIGS. 2, 4, and 5. The ring is split, as at 111, to permit it to be opened to pass the lugs over its surface to enter the openings 114. A two-piece ring may be used for the same purpose. The break-away ring 110 also carries two knob-engaging lugs 118 projecting forward from its side face. These are desirably displaced angularly from the sleeve-engaging lugs 112, for example, at 45° thereto as shown in FIG. 3, and are received in notches 120 cut in the inner flange 58 of the neck 56 of the knob 50. One or both of such sets of lugs 112 and 118 is formed and constructed so as to break away in the event of a predetermined excessive torque between the knob 50 and the knob sleeve 52. Preferably, the break-away or frangible lugs are the lugs 118 which engage the knob neck flange 58. As shown in FIG. 7, the lugs 118 may be formed with notches 122 at their base which weaken the connection between such lugs 118 and the main body of the ring 110, so that the lugs will break away at the weakened section.

The ring 110 and its lugs may be formed as an integral unit of any suitable material, conveniently of a molded plastics material such as nylon. In the position of the ring 110 between the end of the fixed hub 10 and the knob neck flange 58, the ring transmits inward thrust from the knob to the fixed hub 10, and will serve as a thrust bearing. Its manufacture from a material having bearing qualities, such as nylon, facilitates this action of the ring as a thrust bearing.

In the modification of FIGS. 1–5, the hand-hold 54 of the knob is supported from the knob sleeve 52 by a guide ring or plate 98 which is non-rotatably connected to the outer end of the knob sleeve 52 at its inner periphery, and is rotatably engaged at its outer periphery in the bore 68 of the hand-hold 54 against the shoulder 94 in that bore. In accordance with the present invention, such engagement is a rotatable connection which will permit the knob to rotate on the guide ring 98 in the event excessive torque on the knob causes break away of the break-away ring 110. The face plate 108 has an outer flange which lies against the guide plate 98, and may be fixed against rotation with respect to the knob sleeve 52. Preferably, however, the face plate 109 is rotatable with respect to that knob sleeve so that it cannot be used to exert rotative force on the knob sleeve independently of the knob. Accordingly, it is desirably mounted for rotation relative to the knob sleeve 52 and the lock core 80 which is mounted in that knob sleeve (as in FIG. 6). Desirably, it has a sliding fit in the end of the knob so that it is not loose in the knob but may be withdrawn axially with the key-removable core of which it forms a part.

Figure 6:
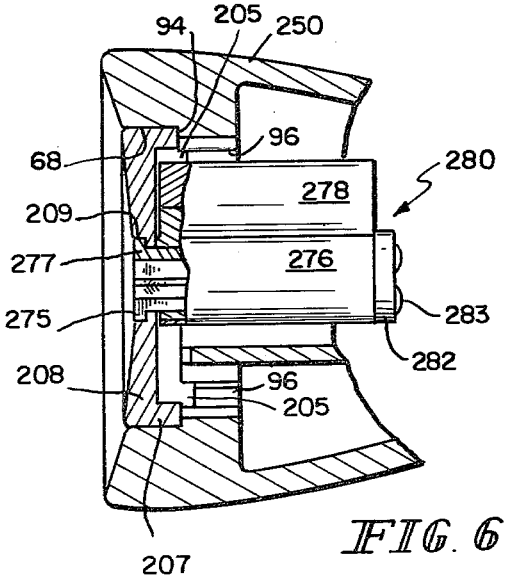
FIG. 6 is a partial sectional view, taken on the line 2—2 of FIG. 1, showing the outer portion of a knob with a core and modified face plate mounted therein.

In the modification of FIG. 6, the locating ring 98 of FIGS. 1–5 is omitted, and the end face 208 is arranged to serve both the purpose of closing the outer opening 68 of the knob 250, and to support the outer end of the knob 250 concentric with the axis of the knob sleeve on which it is mounted. Such support is by way of the core 280 and its key plug 277. The key plug 277 is coaxially mounted in the lower lobe 276 of the core 280, and its forward end carries a peripheral flange 275 which is spaced from the front face of the core. The face plate 208 has a counterbored central opening 209 which receives the forward end and the flange 275 of the key plug, so as to hold the face plate 208 on and rotatable coaxially with the key plug 277. The key plug 277 is held in the core by a rear retaining plate 282 which is fixed to the rear end of the key plug 277 by rivets 283.

The face plate 208 is rotatable not only with respect to the key plug 277 but also with respect to the body of the core 280. Since that core is held against rotation in the knob sleeve, for purposes of the present invention the face plate 208 is made free to rotate with the knob 250 in the event excessive force on such knob 250 causes it to break away from the knob sleeve. Accordingly, the front face of the upper lobe 278 of the core 280 is flat and not connected to the face plate 208, and this leaves that face plate 208 free to rotate about the forward end of the key plug 277. To permit removal of the face plate 208 with the core 280, the face plate 208 may have a slip fit in the opening 68 of the knob. Such slip fit may permit relative rotation of the face plate 208 with respect to the knob 250, but this will do no harm, so long as the arrangement prevents such rotation from transmitting torque to the knob sleeve 52.

In order to locate the face plate 208 axially in the knob 250, and permit that knob 250 to be of the standard construction used in the lock shown in U.S. Pat. No. 3,955,387, the knob sleeve 208 desirably has an outer rearward extending flange 207 which seats against the shoulder 94 in the bore 68 in that standard construction. That standard construction includes a series of circumferentially spaced notches 96 in the inner periphery of the knob 250, inward of the shoulder 94. If desired, the face plate 208 may be formed with lugs 205 at the rear edge of its flange 207 which are received in those notches 96 and lock the face plate 208 against rotation in the knob.

The operation of the lock set containing a break-away ring 110 is as follows. The ring 110 normally connects the knob 50 to rotatably drive the knob sleeve 52 in either direction for all usual purposes. The ring 110 also serves as a thrust bearing between the inner neck flange 58 of the knob and the outer end face of the hub 10. When the blocking lug 127 is in its retracted position shown in full lines in FIG. 1, the knob sleeve 52 is free to rotate with respect to the fixed chassis hub 10, and the knob is operative in the usual way to retract the lock bolt. When the blocking lug 127 is moved to its dotted line position shown in FIG. 1, as by inward thrust from the inside knob button on the control bar 174, the knob sleeve 52 will be locked to the fixed hub 10 and hence locked against rotation. The knob 50 will also be held against rotation but only by reason of its connection to the knob sleeve 52 by the break-away ring 110. In the event an attempt is made to force the lock by applying rotative force on the knob 50, the excess rotative force will break the frangible ring 110 and thereby break the only rotative connection between the knob 50 and the knob sleeve 52. This will defeat the forced entry attempt, for the knob 50 will then be free to rotate on the knob sleeve 52 and incapable of transmitting torque thereto. Once this occurs, the only exposed element which is connected to the knob sleeve 52 will be the front face of the key plug 77. While that key plug 77 can be operated by a proper key to rotate the key-actuated roll back member of the lock, it will present only a limited means of forced attack on the lock.

In the event the break-away ring is broken, it can be readily replaced by removing the knob. For such removal, it is first necessary to remove the lock core 80 by means of a special control key, and to remove the throw member 64. The knob retainer 60 can then be retracted by insertion of a suitable tool through the opening 63 and this will allow the inner neck flange 58 to pass the retracted retainer 60, and allow the knob to be removed. The broken ring 110 is then removed, and a new split ring 110 installed. For such installation, the split ring is first mounted around the projecting end of the knob sleeve 52, and is then pushed rearward until its sleeve-engaging lugs 112 take into the notches 114 in that sleeve. The knob is then replaced, and the notches 120 of its inner flange 58 engaged over the knob-engaging lugs 118 of the new break-away ring. The key-removable core is then returned to its position, and the lock is again ready for use.

We claim:

1. A cylinder lock having a torque-limited knob, comprising a lock chassis, a knob sleeve rotatable in said chassis to retract a lock bolt, and selectively-operable means to block the sleeve from bolt-retracting rotation, said knob sleeve having an outer end adapted to support the outer end of a knob mounted thereon and being formed with a seat to receive a key-operated core non-rotatably mounted therein, a knob mounted for rotation on said sleeve, and means for supporting the knob at the outer end of the sleeve and permitting relative rotation of the knob with respect to the core-receiving seat, and means normally connecting said knob to rotate the sleeve in bolt-retracting rotation, said means including release means which releases such connection under excessive turning force applied to the knob when the sleeve is blocked from bolt-retracting rotation.

2. A cylinder lock as in claim 1 in which said means connecting the knob to the sleeve comprises a frangible element adapted to break and release the connection under excessive turning force applied to the knob so as to disconnect the knob from the sleeve.

3. A cylindrical lock as in claim 1 in which said means connecting the knob to the sleeve comprises a connecting element having a sleeve-engaging lug and a knob-engaging lug, one of said lugs being adapted to break away from the connecting element under excessive torque.

4. A cylindrical lock having a torque-limited knob, comprising a lock chassis, a knob sleeve rotatable in said chassis to retract a lock bolt, and selectively-operable means to block the sleeve from bolt-retracting rotation, a knob mounted for rotation on the axis of said sleeve, and means normally connecting said knob to rotate the sleeve in bolt-retracting rotation, said means including release means which releases such connection under excessive turning force applied to the knob when the sleeve is blocked from bolt-retracting rotation, said means connecting the knob to the sleeve comprising a break-away ring mounted about the sleeve, said ring having a first lug portion for transmitting torque therefrom to the sleeve and having a second lug portion for transmitting torque from the knob to the ring, one of said lug portions being breakable under predetermined torque to release the rotative connection from the knob to the sleeve.

5. A cylinder lock having a torque-limited knob, comprising a lock chassis, a knob sleeve mounted for rotation in said chassis and operating means for connecting the sleeve to retract a lock bolt, said sleeve having mounting means at its outer end to receive a key-operated lock, a knob mounted on said sleeve, a key-operated lock non-rotatably mounted in said sleeve and having a key plug coaxial therewith and exposed for key operation at the end of the knob, and operating means for connecting the key plug to retract the lock bolt, means for blocking rotation of the knob sleeve so as to prevent retraction of the lock bolt thereby, said knob being mounted for rotation relative to the sleeve and key-operated lock, and means normally connecting the knob to rotate the sleeve in bolt-retraction rotation, said means including a frangible part adapted to break away under excessive turning force applied to the knob and thereby release the normally-connecting means.

6. A cylinder lock having a torque-limited knob, comprising a lock chassis, a knob sleeve mounted for rotation in said chassis and operating means for connecting the sleeve to retract a lock bolt, a knob mounted on said sleeve, a key-operated lock mounted in said knob and sleeve and having a key plug coaxial therewith and exposed for key operation at the end of the knob, and operating means for connecting the key plug to retract the lock bolt, means for blocking rotation of the knob sleeve so as to prevent retraction of the lock bolt thereby, said knob being mounted for rotation relative to the sleeve and key-operated lock, and means normally connecting the knob to rotate the sleeve in bolt-retraction rotation, said means including a frangible part adapted to break away under excessive turning force applied to the knob and thereby release the normally-connecting means, said normally-connecting means comprising a break-away ring mounted about the knob sleeve, said ring having a first lug portion engaged with said sleeve and a second lug portion engaged with the knob, one of said lug portions being adapted to break away from the ring under predetermined torque so as to release the rotative connection from the knob to the sleeve.

7. A cylinder lock having a torque-limited knob, comprising a lock chassis, a knob sleeve mounted for rotation in said chassis and operating means for connecting the sleeve to retract a lock bolt, a knob mounted on said sleeve, a key-operated lock mounted in said knob and sleeve and having a key plug coaxial therewith and exposed for key operation at the end of the knob, and operating means for connecting the key plug to retract the lock bolt, means for blocking rotation of the knob sleeve so as to prevent retraction of the lock bolt thereby, said knob sleeve being mounted for rotation relative to the sleeve and key-operated lock, means normally connecting the knob to rotate the sleeve in bolt-retraction rotation, said means including a frangible part adapted to break away under excessive turning force applied to the knob and thereby release the normally-connecting means, a tubular hub on said chassis in which said knob sleeve is rotatably mounted, said knob having a neck portion surrounding the hub and having an inward extending flange opposite the end of the hub, said normally-connecting means comprising a ring mounted about the sleeve, radially between the sleeve and said neck portion and axially between the hub and said flange, said ring having a set of one or more radial lugs engaged in corresponding openings in the sleeve for connecting the ring for rotation with the sleeve, and said ring having a set of one or more axial lugs engaged in corresponding openings in said flange of the knob neck portion for connecting the ring for rotation with the knob, one of said sets of lugs being adapted to break under predetermined torque between the knob and sleeve so as to release the rotative connection therebetween.

8. A cylinder lock as in claim 7 in which said ring is formed of bearing material and forms a thrust bearing between the knob flange and the hub.

9. A cylinder lock having a torque-limited knob, comprising a knob sleeve which is normally rotatable to retract a lock bolt, and selectively operable means for blocking rotation thereof, a knob mounted about said sleeve, a torque-limiting ring between the sleeve and knob and having keying means keying the same both to the knob and to the sleeve for transmitting normal rotative movement of the knob to the sleeve, the ring including a breakable part adapted to break under predetermined torque between the knob and sleeve and thereby release the knob from rotative connection with the sleeve.

10. A torque-limiting ring for connecting the knob sleeve of a cylinder lock to a knob mounted thereon, comprising a ring adapted to be mounted between the sleeve and a surrounding portion of the knob, a first set of one or more lugs thereon for reception in a corresponding set of openings in the sleeve for keying the ring to the sleeve, a second set of one or more lugs on the ring for reception in a corresponding set of openings in the knob for keying the ring to the sleeve, one of said sets of lugs being breakable under predetermined excessive torque applied thereto so as to disconnect the rotative connection from the knob to the sleeve.

* * * * *